United States Patent [19]

Araki et al.

[11] Patent Number: 4,825,546

[45] Date of Patent: May 2, 1989

[54] HAIR CLIPPER

[75] Inventors: Masakatsu Araki; Hideaki Haraguchi, both of Hikone; Shinichirou Tsujimura, Nagahama; Kouichi Iwanaga, Hikone, all of Japan

[73] Assignee: Matsushita Electric Works, Ltd., Osaka, Japan

[21] Appl. No.: 84,041

[22] Filed: Aug. 11, 1987

[30] Foreign Application Priority Data

Aug. 26, 1986 [JP] Japan ..... 61-200665

[51] Int. Cl.[4] ..... B26B 19/00

[52] U.S. Cl. ..... 30/201; 30/195; 30/196

[58] Field of Search ..... 30/195–200, 30/201, 202, 43.1, 216–220

[56] References Cited

U.S. PATENT DOCUMENTS

| | | | |
|---|---|---|---|
| 1,895,292 | 1/1933 | Miner | 30/210 |
| 1,908,385 | 5/1933 | Wahl | 30/195 |
| 2,470,287 | 5/1949 | Carter | 30/201 |
| 3,357,101 | 12/1967 | Davis | 30/210 |
| 4,118,863 | 10/1978 | Sandy | 30/195 |
| 4,152,830 | 5/1979 | Meijer et al. | 30/201 X |
| 4,557,050 | 12/1985 | Haraguchi et al. | 30/201 X |
| 4,581,822 | 4/1986 | Fujimura | 30/201 X |
| 4,669,189 | 6/1987 | Ullmann | 30/201 |

FOREIGN PATENT DOCUMENTS

| | | | |
|---|---|---|---|
| 0119285 | 9/1984 | European Pat. Off. | 30/201 |
| 3310706 | 9/1984 | Fed. Rep. of Germany | 30/201 |
| 0060751 | 5/1977 | Japan | 30/201 |
| 0036859 | 3/1979 | Japan | 30/220 |
| 0098857 | 8/1979 | Japan | 30/216 |
| 0121873 | 9/1979 | Japan | 30/201 |

*Primary Examiner*—Eugene R. LaRoche
*Assistant Examiner*—Seung Ham
*Attorney, Agent, or Firm*—Armstrong, Nikaido, Marmelstein, Kubovcik & Murray

[57] ABSTRACT

A hair clipper has cutter head comprising a set of a stationary blade and a movable blade each having teeth in its forward edge. The movable blade is driven to reciprocate on the stationary blade for hair shearing. The hair shearing can be operated selectively at either of hair cutting, hair trimming, and hair thinning modes which are characterized to have respective effective hear shearing zones of different capability optimum suitable for the intended modes.

11 Claims, 11 Drawing Sheets

HAIR CLIPPER

FIELD OF THE INVENTION

The present invention is directed to a hair clipper, and more particularly to a hair clipper with a hair thinning capability.

DESCRIPTION OF THE PRIOR ART

As has been proposed in U.S. Pat. 4,557,050 assigned to the assignee of the present invention, a hair clipper is known to have a hair thinning capability in addition to its hair cutting capability so that the user can utilize both of the hair styling modes with a signal device. As to the hair cutting capability, the prior hair clippers with or without the added capability of hair thinning have been successful in providing sharp or close cut enough for efficient hair cutting operation. However, the sharp cut feature may sometimes cause an adverse effect of overcutting the hairs, particularly at the time of trimming hairs by an unskilled user. To this end, there have been proposed a scheme to selectively use one of different cutter assemblies which are separately designed for specific hair styling requirements, i.e., for hair cutting and hair trimming. However, such scheme involves additional operation for replacing the cutter assembly as well as requires duplication of components. Therefore, the prior art hair clippers are not totally satisfactory for the unskilled user in providing an easy hair styling operations in each of hair cutting, hair thinning, and hair trimming modes with a single cutter assembly.

SUMMARY OF THE INVENTION

The present invention eliminates the above inconvenience by incorporating a unique concept into a hair clipper. The hair clipper in accordance with the present invention comprises a single set of a stationary blade and a movable blade each having a forward edge with a row of teeth extending therealong. The movable blade is driven by a drive means to reciprocate for shearing engagement with the stationary blade. The characterizing feature of the present invention resides in that the hair clipper includes a mode selection means for selectively engaging the movable blade with the stationary blade in either of a hair cutting condition, a hair trimming condition, and a hair thinning condition each providing an effective shearing zone of different shearing capability from each other. The hair cutting condition provides a first effective shearing zone which is defined by that substantially the entire teeth of the stationary blade are in hair shearing engagement with those of the movable blade. The hair trimming condition provides a second effective shearing zone which is defined by that particular regions of the teeth of the stationary blade are in hair shearing engagement with the corresponding teeth of the movable blade. The hair thinning condition provides a third effective shearing zone which is defined by that particular ones of the teeth of the stationary blade are in hair shearing engagement with the corresponding teeth of the movable blade. With the inclusion of the hair trimming mode in addition to the hair cutting and thinning modes, an unskilled user can rely upon the trimming mode of rather reduced cutting capability than the hair cutting mode and therefore can easily perform hair trimming treatment without a danger of overcutting.

Accordingly, it is a primary object of the present invention to provide an improved hair clipper which is capable of affording different modes of hair styling with the added capability of easily performing the hair trimming treatment even by an unskilled user, all with the use of a single set of the movable and stationary blades.

In a first version of the present invention, the movable blade is allowed to shift in a direction of varying the depth by the extent of which the teeth of the movable blade is to be in shearing engagement with those of the stationary blade, or varying the length of hair cut effected thereby. The stationary blade is formed in its forward edge with a row of composite teeth having first teeth of small depth which are divided into several groups alternated by second teeth of large depth. The movable blade is operatively connected to the mode selection means in the form of a slide handle so that it is selectively shifted by the manipulation thereof into the hair cutting, hair trimming, and hair thinning conditions. In the hair cutting condition, the entire depth of each of the first teeth and the corresponding depth of the second teeth of the stationary blade are in shearing engagement with those of the movable blade to thereby define the above first effective shearing zone. In the hair trimming condition, only the bottom portion in the depth of each of the first and second teeth of the stationary blade is in hair shearing engagement with those of the movable blade to thereby define the above second effective shearing zone. In the hair thinning condition, only the bottom portion of each of the second teeth of the stationary blade is in hair shearing engagement with those of the movable blade to thereby define the above third effective shearing zone. With this arrangement, the different hair styling modes can be obtained without requiring any additional cutting element or the like complicate elements and the selection among the different hair styling modes can be easily made simply by shifting the movable blade into the corresponding condition.

It is therefore another object of the present invention in which the movable blade is capable of shifting relative to the stationary blade in the direction perpendicular to the reciprocation so as to provide the hair cutting, trimming, and thinning conditions.

In a second version of the present invention, the mode selection means comprises a comb member disposed closely adjacent to the stationary blade with its forward edge in parallel relation with the forward edge thereof. The comb member is formed in its forward edge with a less number of comb teeth than the stationary blade, which comb teeth are spaced to each other at an interval at least double that of the teeth of the stationary blade. The comb member can be shifted selectively into the hair cutting, trimming, and thinning conditions. In the hair cutting condition, the comb member is retracted away from the teeth of the stationary blade to expose all of the teeth to thereby define the above first effective shearing zone where the substantially the entire teeth of the stationary blade are utilized for the hair cutting. In the hair trimming condition, the forward edge of the comb member extends over the bottom portions of the teeth of the stationary blade to render those portion inoperatively closed while leaving exposed the top portions of the teeth and the entire depth of the particular teeth being in registration with the comb teeth for limited shearing operation by those exposed teeth, which defines the above second effective shearing zone. In the hair thinning condition, the comb member extends over the entire depth of the teeth of the stationary blade so as to expose only the particular teeth in registration with the comb teeth for a further limited shearing operation while rendering the remaining teeth inoperative, which defines the above third effective shearing zone. With the inclusion of the comb member, the hair clipper can have different modes of hair styling operations without requiring to shift the movable blade.

It is therefore a further object of the present invention to provide a hair clipper in which a comb member with comb teeth is associated with the stationary blade for providing the different modes of hair styling operations.

Each of the first and second versions of the hair clipper may include means for varying the rate of reciprocation of the movable blade in such a way as to reciprocate the movable cutter faster in the hair cutting mode than in the hair trimming mode. This contributes to greatly differentiating the amount of hair cut between the hair cutting and trimming mode so that the hair trimming operation can be made rather slowly, allowing the user to handle the hair clipper more easily in trimming the hair into a desired finish.

It is therefore a further object of the present invention to provide a hair clipper which allows the hair trimming operation to be made at a slower cutting rate than the hair cutting mode, ensuring easy and delicate hair trimming treatment.

In a third version of the present invention, a means is provided to selectively vary the amplitude of reciprocation of the movable blade between a first, a second, and a third modes respectively determining the hair cutting, trimming and thinning conditions. The first mode provides a maximum amplitude of reciprocation which permits each tooth of the movable blade to be in shearing engagement with a maximum number of the teeth of the stationary blade. Thus, all the teeth are most effectively utilized to give a maximum shearing capability optimum for the hair cutting. The second mode provides a medium amplitude of reciprocation which permits each tooth of the movable blade to be in shearing engagement with a less number of the teeth of the stationary blade than in the hair cutting mode, providing a hair shearing of reduced capability required for the hair trimming. The third mode provides a minimum amplitude of reciprocation which permits only a limited number of the teeth of the stationary blade to come into shearing engagement with the teeth of the movable blade while rendering the remaining teeth of the stationary blade to be out of shearing engagement therewith, allowing the hair shearing to be made only at particular locations effective for a hair thinning purpose.

It is therefore a still further object of the present invention to provide a hair clipper which is capable of providing different hair styling modes by selectively varying the amplitude of reciprocation of the movable blade.

The above means comprises a stepped eccentric shaft connected between a motor output shaft and the movable blade in order to translate the rotational movement of the motor output shaft into the reciprocatory motion of the movable blade. The eccentric shaft is formed with a first, a second, and a third stepped sections each extending in parallel relation with the axis of the motor output shaft with different eccentricity therefrom. The eccentric shaft is engageable at a selected one of the sections with a portion of the movable blade so as to drive it at an amplitude of reciprocation depending upon the eccentricity of the section of the eccentric shaft selected to be engaged with the movable blade.

It is therefore a further object of the present invention in which the movable blade is drivingly connected to the motor through the stepped eccentric shaft having sections of different eccentricity so as to vary the amplitude of reciprocation of the movable blade in a stepwise manner between the different hair styling modes.

These and still other object and advantages will become more apparent from the following description of the preferred embodiments of the present invention when taken in conjunction with the accompanying drawings.

DETAILED DESCRIPTION OF THE PREFERRED EMBODIMENTS

First embodiment <FIGS. 1 to 7>

Figure 1:
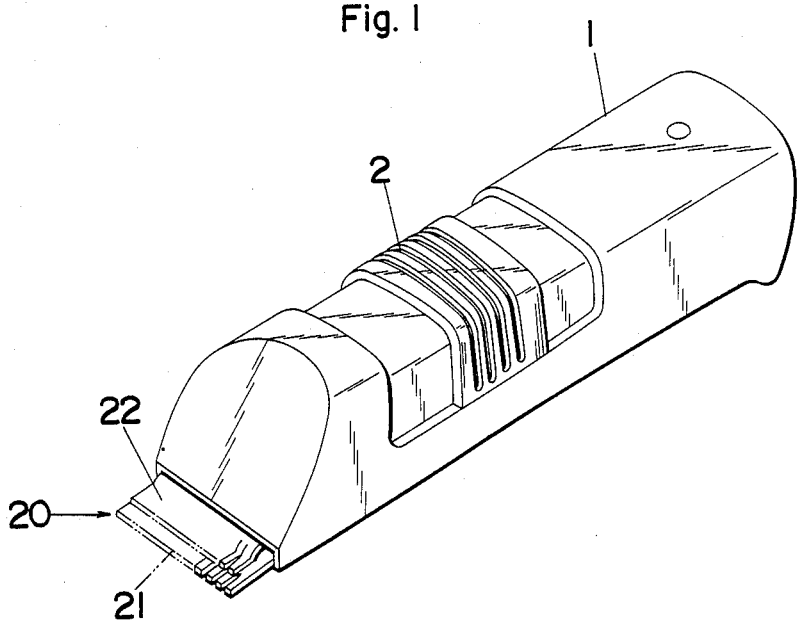
FIG. 1 is a perspective view of a hair clipper in accordance with a first preferred embodiment of the present invention.
Figure 2:
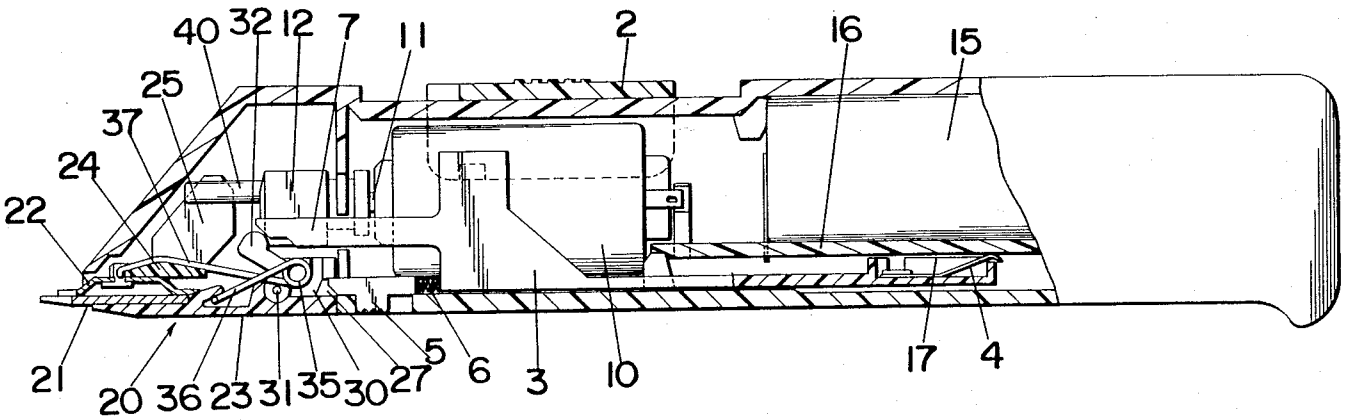
FIG. 2 is a longitudinal section of the hair clipper.
Figure 3A:
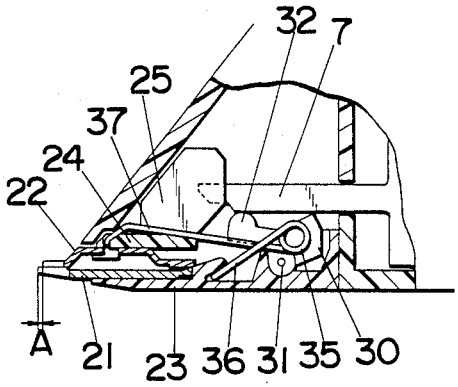
FIGS. 3A, 4A, and 5A are partial sectional views of a cutting head of the hair clipper respectively shown in hair cutting, trimming and thinning conditions.
Figure 3B:
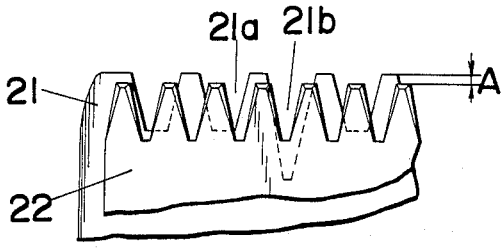
FIGS. 3B, 4B, and 5B are partial plan views respectively illustrating the positions of a movable blade relative to a stationary blade of the cutting head, respectively in hair cutting, trimming, and thinning conditions.
Figure 4A:
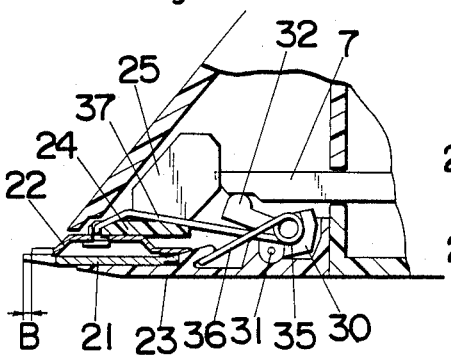
Figure 4B:
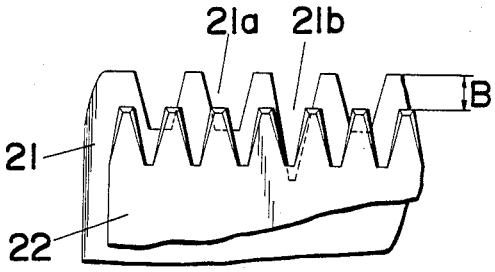
Figure 5A:
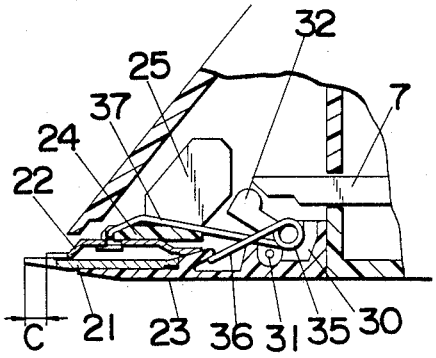
Figure 5B:
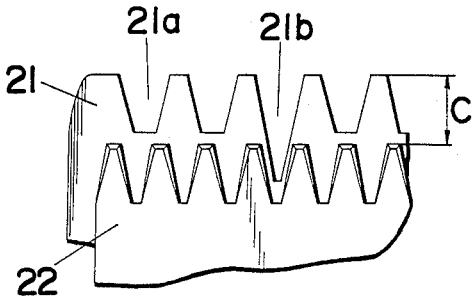

Referring now to FIGS. 1 and 2, a hair clipper in accordance with a first preferred embodiment of the present invention comprises an elongated housing 1 mounting therein an electric motor 10 and a rechargeable battery 15. A switch handle 2 is slidably mounted on the top of the housing 1 for connecting and disconnecting the motor 10 from the battery 15. Mounted inside of the housing 1 is a slide member 3 which is coupled to the switch handle 2 to be movable therewith so that, when the switch handle 2 is pushed forward, a spring contact 4 at the rear end of the slide member 3 comes into electrical contact with a corresponding contact 17 on a circuit board 16 fixed inside of the housing 1 to energize the motor 10. Located at the front end of the housing 1 is a cutter head 20 which comprises a single set of stationary blade 21 and a movable blade 22 each having a row of teeth along the forward edge thereof. The stationary blade 21 is fixed on a base plate 23 with its forward edge projecting outwardly of the front end of the housing 1. The base plate 23 is detachably fitted in the front bottom of the housing 1 and is kept in place by means of a slide knob 5 which is biased by a spring 6 to extend into a catch recess 27 in the rear end of the base plate 23. The movable blade 22 is fixed to a carrier plate 24 to be reciprocable therewith relative to the stationary blade 21. The combination of the movable blade 22 and the carrier plate 24 is supported on the base plate 23 by means of torsion springs 35 (only one of which is seen in the figures) which allow the combination to reciprocate as well as urge the movable blade 22 against the stationary blade 21 at a suitable pressure. Each of the torsion springs 35 is supported at its coiled portion by a rocker element 30 which is supported on the base plate 23 to be pivotable about a pivot axis 31 extending transversely of the housing 1 and being offset forwardly of the coiled portion. One extension 36 of the torsion springs 35 is hooked to the base plate 23 and the other extension 37 engages the carrier plate 24 such that the movable blade 22 is spring biased against the stationary blade 21 as well as that it is allowed to reciprocate as resiliently flexing the extension 37 of the torsion spring 35. The carrier plate 24 is integrally formed with a pair of upstanding yoke legs 25 for driving connection with an output shaft 11 of the motor 10 through an eccentric coupling which translates the rotational movement of the motor output shaft 11 into the reciprocatory movement of the movable blade 22. The eccentric coupling comprises an eccentric shaft 40 held on a joint 12 and connected to the motor output shaft 11 through the joint 12 in an eccentric relation thereto. The eccentric shaft 40 extends between the yoke legs 25 where it is engaged therewith for driving the movable blade 22 together with the carrier plate 24 in a reciprocation path.

Extending from the rocker element 30 are a pair of transversely spaced levers 32 (only one of which is seen in the figures) for abutment with the front end of each of actuator rods 7 extending forwardly from the slide member 3. It is noted at this time that since the movable blade 22 is connected to the rocker element 30 through the torsion springs 35, the movable blade 22 can be shifted back and forth in the longitudinal direction of the housing 1 as the rocker element 30 pivots about its pivot axis 31. In the absence of external force, the rocker element 30 is spring biased about its pivot axis 31 by the action of the torsion springs 35 into a position of FIG. 2 where the movable blade 22 is kept in its rearwardmost position relative to the stationary blade 21. Consequently, when the actuator rods 7 of the slide member 3 push the levers 32 to pivot the rocker element 30 in the counterclockwise direction as viewed in the figures, the movable blade 22 and the carrier plate 24 are together forced to shift forwardly against the bias of the torsion springs 35. During this shifting movement, the movable blade 22 is kept urged against the stationary blade 21 by the resiliency of the torsion springs 35 while the yoke legs 25 of the carrier plate 24 is kept engaged with the eccentric shaft 40 for maintaining the driving connection between the motor 10 and the movable blade 22.

The front end of the actuator rod 7 is shaped to have a stepped shoulder for abutment with the corresponding lever 31 in a stepwise manner, as shown in FIGS. 3A to 5A. That is, the movable blade 22 can assume three different positions of FIGS. 3A to 5A (FIGS. 3B to 5B) depending upon the amount of the forward displacement of the actuator rods 7, or the corresponding sliding movement of the switch handle 2. In operation, when the switch handle 2 is manipulated to advance the actuator rods 7 into the positions of FIGS. 5A and 5B, the motor 10 is energized to reciprocate the movable blade 22 being in its rearwardmost position with respect to the longitudinal direction of the housing .. The motor 10 is kept energized on further advancement of the actuator rods 7 to keep reciprocating the movable blade 22 in the correspondingly shifted positions of FIGS. 4A and 4B.

Figure 6:
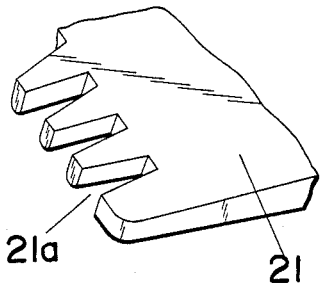
FIG. 6 is a fragmentary view of the stationary blade.
Figure 7A:
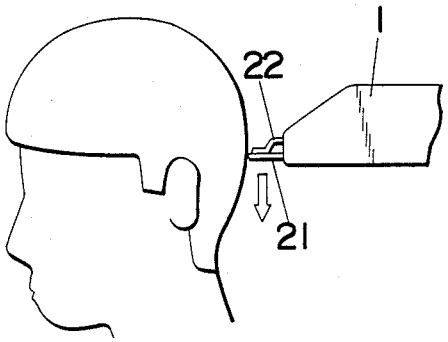
FIGS. 7A and 7B schematic views respectively illustrating the hair clipper manipulated at different positions during the hair styling operations.
Figure 7B:
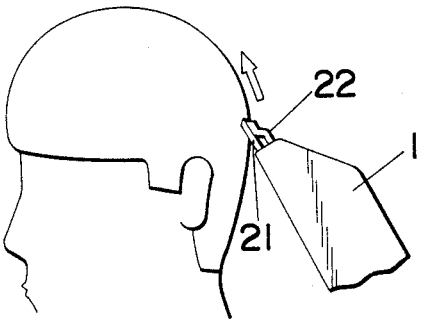

As shown in FIGS. 3B to 5B, the stationary blade 21 is formed in along its forward edge with a row of teeth which is composed of first teeth **21*a* of smaller depth and second teeth 21*b* (only one of which is seen in the figure) of larger depth, while the movable blade 22 is formed along its forward edge with a row of teeth of equal depth. The second tooth 21*b* of larger depth appears in every third occurrence in the row in such a way that the first teeth 21*a* of smaller depth are divided into several groups which are alternated by the second teeth 21*b*. When the movable blade 22 is shifted to the forwardmost position of FIG. 3A and 3B to leave a minimum clearance A between the forward edges of the stationary and movable blades 21 and 22, it is cooperative with the stationary blade 21 to give a hair cutting mode in which the effective shearing zone is defined by that substantially the entire depth of the first teeth 21*a* and the corresponding depth of the second teeth 21*b* of the stationary blade 21 come into shearing engagement with the teeth of the movable blade 22. Thus, in the hair cutting mode substantially the entire teeth of the stationary blade 21 are utilized to provide a sharp shearing performance which is desired for hair cutting operation. When the movable blade 22 is shifted to the intermediate position of FIGS. 4A and 4B with a medium clearance B between the forward edges of the blades 21 and 22, it gives a hair trimming mode in which the effective shearing zone is defined by that only the bottom portions of the first and second teeth 21*a* and 21*b* of the stationary blade 21 come into hair shearing engagement with those of the movable blade 22 to thereby provide a rather rough shearing performance in comparison with the hair cutting mode. In other words, the hair trimming mode thus defined can provide a hair styling performance in which all the teeth of the stationary blade 22** serves to shear the hair reduced but with a reduced cut length for permitting an easy hair trimming or finishing hair treatment which would be otherwise difficult to be made with the hair cutting mode having inherently a sharper or close cut capability. In this hair trimming mode, the forward edge of the movable blade 22 is displaced rearwardly from that of the stationary blade by a distance of 1.5 mm, optimum for such hair trimming operation. When the movable blade 22 is shifted to the rearmost position of FIGS. 5A and 5B with a maximum clearance C between the forward edges of the blades 21 and 22, it gives a hair thinning mode in which the effective shearing zone is defined by that only the second teeth 21*b* of the stationary blade 21 has its bottom portions into shearing engagement with the teeth of the movable blade 22, providing a suitable hair thinning performance. The selection between the above three different hair styling modes can be made by simply manipulating the switch handle 2 by a thumb of the user's hand holding the hair clipper and therefore can be made during the hair styling without interruption. For example, the user can easily change the mode from the hair thinning operation of FIG. 7A to the hair cutting operation of FIG. 7B and vice versa. It is noted at this time that the bottom edge of each tooth of the stationary blade 21 to be in direct contact with the skin of the subject is rounded, as shown in FIG. 6 so as not to injure the skin during the hair styling operation. Although in the above embodiment, the movable blade 22 is rendered to be movable in the direction perpendicular to the reciprocation, it is equally possible to make the stationary blade 21 movable in that direction relative to the movable blade 22 for changing the hair styling modes by the relative movement of the stationary blade 21 to the movable blade 22.

Figure 8:
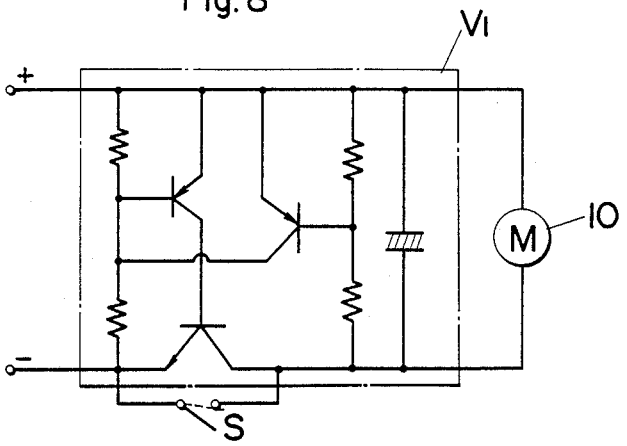
FIGS. 8 to 11 are diagrams respectively illustrating several control circuits for driving a motor adaptable in the hair clipper.
Figure 9:
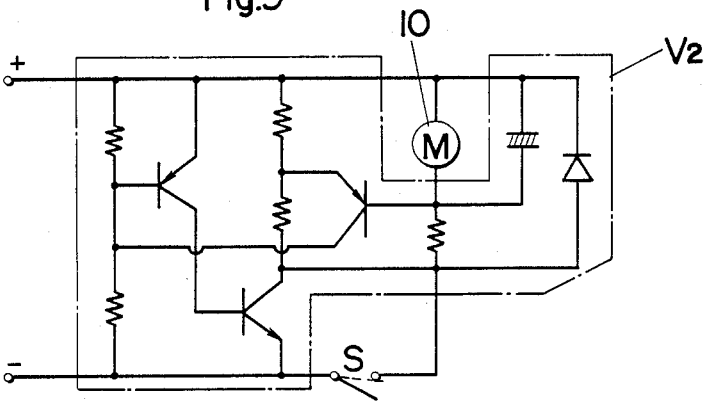
Figure 10:
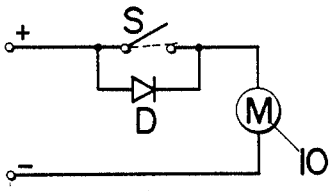
Figure 11:
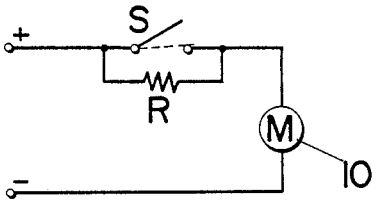
Figure 12:
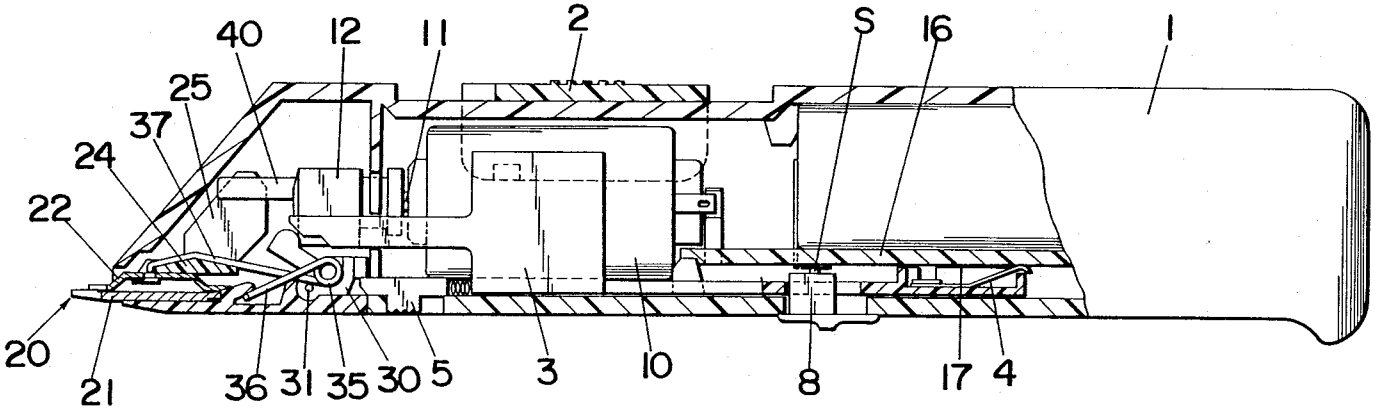
FIG. 12 is a longitudinal section of a hair clipper in accordance with a modification of the above first embodiment.

Preferably, the hair trimming mode is designed to have a reduced rate of reciprocation of the movable blade 22 than the hair cutting mode in order to greatly differentiate the amount of hair being cut per unit time between the two modes. This permits the hair trimming operation to be made at a slower pace and therefore can correspondingly afford more time or margin in hair trimming operation by the user, facilitating to obtain a skillful hair trimming. To this end, there is introduced a control circuit connected between the battery 15 and the motor 10 for varying the rate of rotation of the motor 10. The control circuit may be any one of a circuit with a voltage-control circuitry V1 of FIG. 8, a circuit with a voltage-control circuitry V2 of FIG. 9, a circuit with a diode D of FIG. 10, or a circuit with a resistor R of FIG. 11. In each control circuit, a bypass switch S is included to selectively drive the motor 10 either at a high speed or a low speed rate. The switch S may be actuated in synchronism with the slide movement of the switch handle 2 or may be actuated independently thereof. In the latter case, a switch slide 8 is mounted in the bottom of the housing 1 for actuation of the bypass switch S of the control circuit formed on the board 16. Although the control circuit is utilized in the above to only vary the rate of reciprocation between the hair cutting mode and the hair trimming mode, it may be also effective to vary the rate of reciprocation in the hair thinning mode.

Second embodiment <FIGS. 13 to 17>

Figure 13:
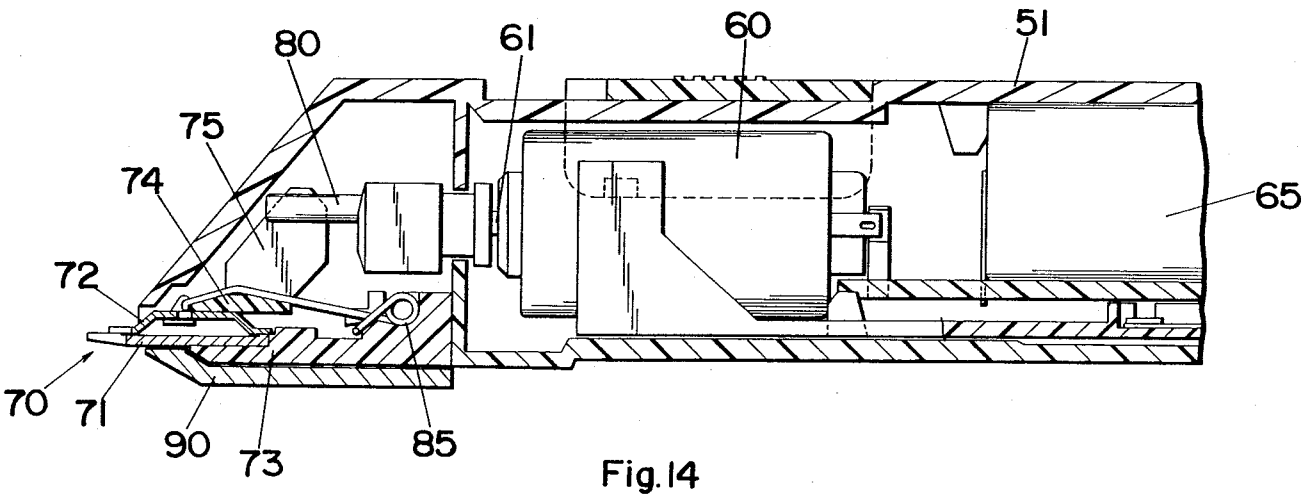
FIG. 13 is a longitudinal section of a hair clipper in accordance with a second preferred embodiment of the present invention.
Figure 14:
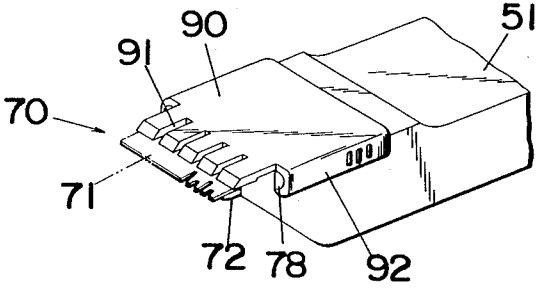
FIG. 14 is a perspective view illustrating the bottom of the cutter head of the hair clipper of FIG. 13.

Referring to FIGS. 13 and 14, a hair clipper in accordance with the second preferred embodiment is shown which is generally similar to the first embodiment. The hair clipper comprises a cutter head 70 formed at the front end of a housing 51 in which a motor 60 and a rechargeable battery 65 are mounted. The cutter head 70 comprises a stationary blade 71 fixed on a base plate 73 and a movable blade 72 driven by the motor 60 to reciprocate on the stationary blade 71. Additionally included in the cutter head 70 is a comb member 90 which is attached onto the bottom of the base plate 73 with upturned side flanges 92 slidably engaged with corresponding rails 78 on the lateral sides of the base plate 73 so that it is shiftable in the longitudinal direction of the housing 51 in relation to the stationary blade 71. The movable blade 72 is held on a carrier plate 74 and is supported on the base plate 73 by means of a pair of torsion springs 85 (only one of which is seen in FIG. 13) in such a manner that it is allowed to reciprocate while being kept immovable in the direction perpendicular to the reciprocation. Each of the torsion springs 85 has its coiled portion fixedly received in the rear end of the base plate 73 so as to urge the movable blade 72 against the stationary blade 71 at a suitable pressure in the like manner as in the first embodiment. The driving connection of the movable blade 72 to a motor output shaft 61 is established through yoke legs 75 on the carrier plate 74 and an eccentric shaft 80 in the like manner as in the first embodiment. The stationary blade 71 has a row of teeth of equal depth in the forward edge which is in constant shearing engagement with the teeth of the movable blade 72 as opposed to the first embodiment. As shown in FIGS. 14 to 17, the comb member 90 is formed in its forward edge with a row of comb teeth 91 which are spaced at an interval approximately three times that of the teeth of the stationary blade 71, each comb teeth 91 having a configuration slightly larger than the tooth of the stationary blade 71.

Figure 15:
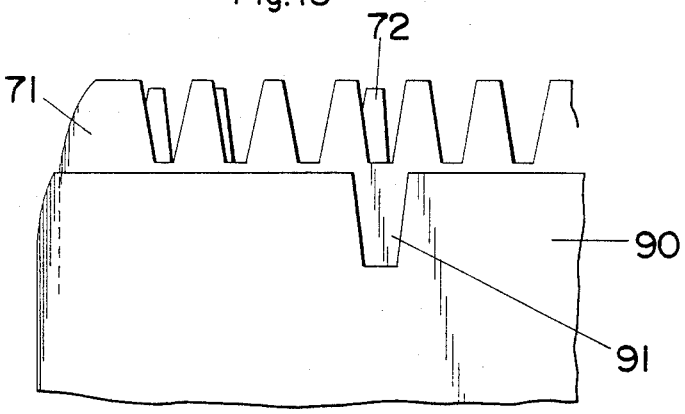
FIGS. 15 to 17 are partial plan views illustrating the positions of a comb member relative to the stationary blade, respectively in the hair cutting, trimming, and thinning conditions.
Figure 16:
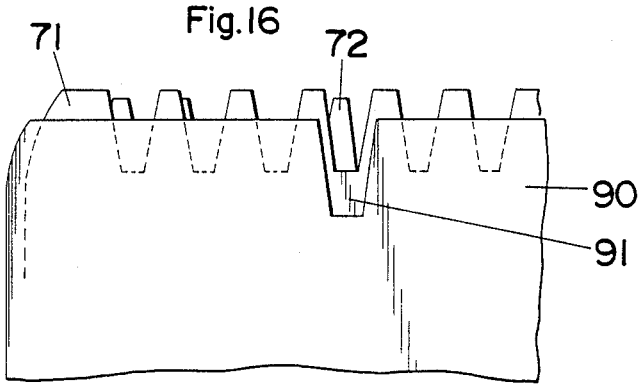
Figure 17:
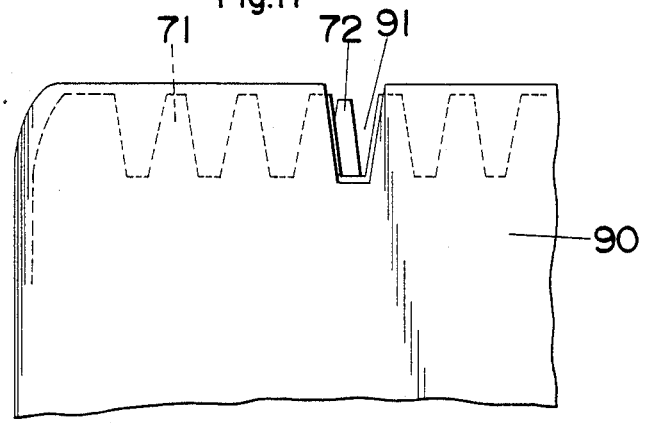
Figure 18:
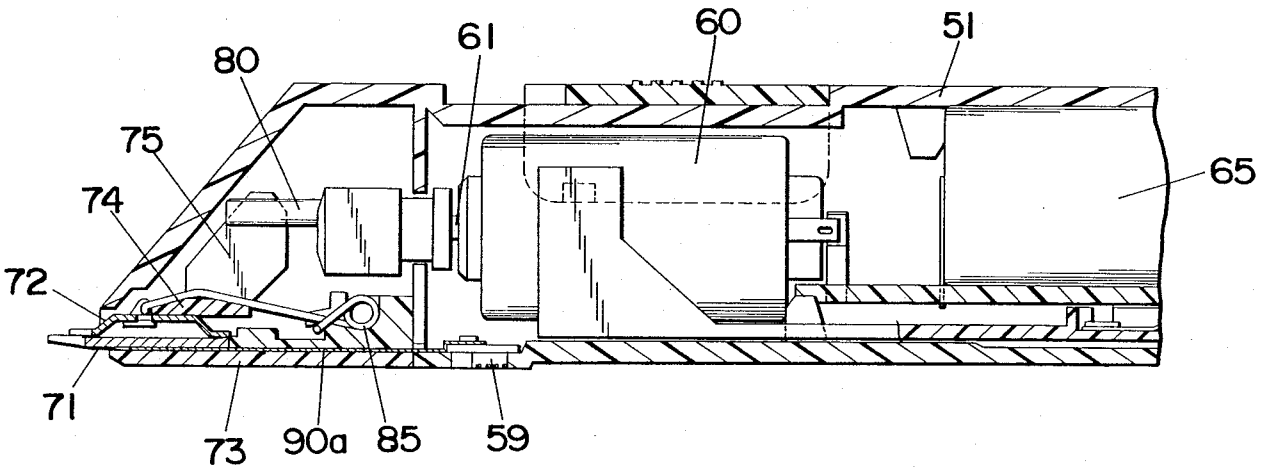
FIG. 18 is a longitudinal section of a hair clipper in accordance with a modification of FIG. 13.

In operation, the comb member 90 is manipulated to be shifted selectively into either of a hair cutting position of FIG. 15, a hair trimming position of FIG. 16, and a hair thinning position of FIG. 17 and clicked into position. When the comb member 90 is retracted to its rearwardmost, or hair cutting position of FIG. 15, the entire teeth of the stationary blade 71 is exposed to define an effective shearing zone with the entire teeth of the movable blade 72, permitting the hair cutting operation to be effected through the entire teeth of the stationary and movable blades 71 and 72. When the comb member 90 is advanced to its intermediate position, or hair trimming position of FIG. 16, the forward edge of the comb member 90 extends over the bottom portions of the teeth of the stationary blade 71 to close these portions while leaving exposed the top portions of the teeth and the entire depth of the particular teeth of the stationary blade 71 in registration with the comb teeth 91, permitting the exposed portion of the teeth of the stationary blade 71 to be in a rather limited shearing engagement with the teeth of the movable blade 72. Thus, the hair trimming operation can be easily effected with the limited hair shearing capability. When the comb member 90 is advanced to its forwardmost position, or hair thinning position of FIG. 17, the forward edge of the comb member 90 extends past the forward edge of the stationary blade 71 so as to only expose the particular teeth thereof of the stationary blade 71 in registration with the comb teeth 91, permitting the shearing only at such particular teeth and thereby providing the hair thinning performance. Although in the above embodiment the comb member 90 is attached on the bottom of the base plate 73, a like comb member 90*a* with comb teeth may be held between a base plate 73 and a stationary blade 71, as shown in FIG. 18, and operated by a slide handle 59 on the bottom of the housing 51. It is noted at this time that the control circuit adaptable to the first embodiment for varying the rate of reciprocation of the movable blade can be also adapted to the hair clipper of the second embodiment.

Third embodiment <FIGS. 19 to 23>

Figure 19:
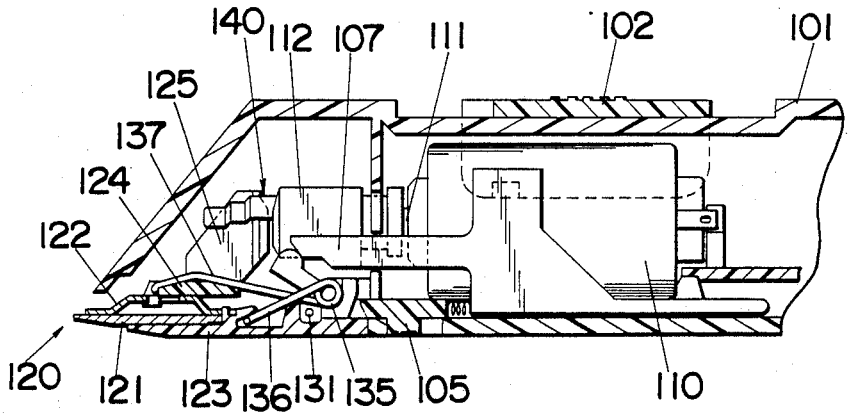
FIG. 19 is a longitudinal section of a hair clipper in accordance with a third preferred embodiment of the present invention.
Figure 20:
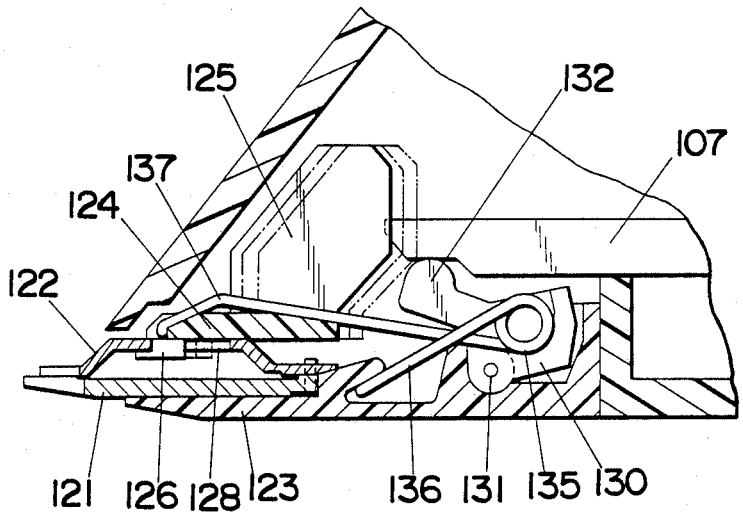
FIG. 20 is a partial sectional view of a cutting head of the hair clipper of FIG. 19.

A hair clipper in accordance with a third preferred embodiment of the present invention is similar in construction with the first embodiment except for a driving mechanism for a movable blade 122 and the tooth configuration of a stationary blade 121. A motor 110 is mounted within a hair clipper housing 101 and is energized by the manipulation of a switch handle 102 for causing the movable blade 122 to reciprocate on the stationary blade 121. A cutter head 120 includes a base plate 123 on which the stationary blade 121 is fixed and which is detachably mounted in the front bottom of the housing 101 by means of a knob 105, as shown in FIG. 19. The movable blade 122 is connected to a carrier plate 124 and is driven to reciprocate together therewith in a reciprocation path. The carrier plate 124 is supported by a pair of torsion springs 135, in the same manner as in the first embodiment, so that the movable blade 122 is spring biased against the stationary blade 121 and is allowed to reciprocate as resiliently flexing extensions 136 and 137 of the torsion spring 135. The coiled portion of each torsion spring 135 is received in a rocker element 130 which is mounted on the rear of the base plate 123 to be pivotable about its pivot axis 131. By the resiliency of the torsion springs 135 the rocker element 130 is biased in the clockwise direction, as viewed in the figures, to correspondingly bias the carrier plate 124 rearwardly. The rocker element 130 has a pair of radially extending and laterally spaced levers 132 (only one of which is seen in the figures) each for abutment with an actuator rod 107 which is slidable within the housing 101 in synchronism with the sliding movement of the switch handle 102. The rocker element 130 is caused to pivot in the counterclockwise direction by the operation of the switch handle 102 to thereby shift the carrier plate 124 in the direction perpendicular to the reciprocation of the movable blade 122. As best shown in FIG. 20, the carrier plate 124 is formed with an integral stud 126 which extends into an opening 128 in the movable blade 122 for establishing such a connection that the movable blade 122 is driven to reciprocate together with the carrier plate 124 while the carrier plate 124 is allowed to be shifted independently of the movable blade 122 into different positions, as indicated by dotted lines in FIG. 20, along the direction perpendicular to the reciprocation of the movable blade 122.

An eccentric shaft 140, which is coupled through a joint 112 to a motor output shaft 111, extends between a pair of upstanding yoke legs 125 on the carrier plate 124 where it is engaged with a vertical rib 129 on at least one of the yoke legs 125 for driving the movable blade 122 and the carrier plate 124 to reciprocate together upon rotation of the motor output shaft 111. The eccentric shaft 140 is in the form of a stepped shaft having three sections 141, 142, and 143 of different eccentricity with respect to a center axis of the motor output shaft 111. It is the vertical rib 129 on the yoke leg 125 that comes engaged selectively with one of the sections 141, 142, 143 of different eccentricity as the carrier plate 124 is shifted longitudinally of the housing 101 by the manipulation of the switch handle 102. The eccentricity is greater at the section closer to the joint 112 than at the adjacent section remote from the joint 112.

Figure 21A:
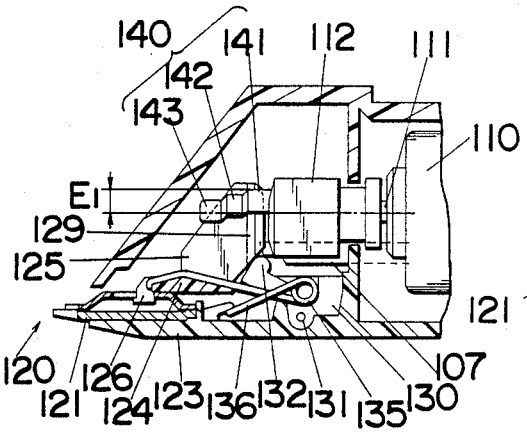
FIGS. 21A, 22A, and 23A are partial sectional views of the cutting head of the hair clipper respectively shown in hair cutting, trimming and thinning conditions.
Figure 21B:
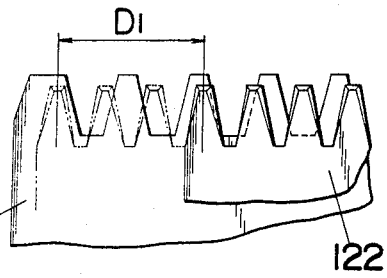
FIGS. 21B, 22B, and 23B are partial plan views illustrating the relative positions of a movable blade relative to a stationary blade of the cutting head, respectively in hair cutting, trimming, and thinning conditions.
Figure 22A:
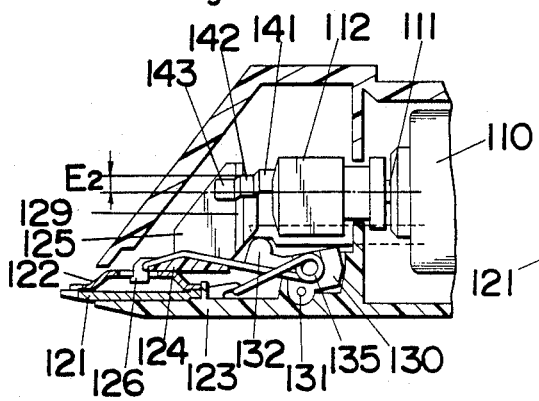
Figure 22B:
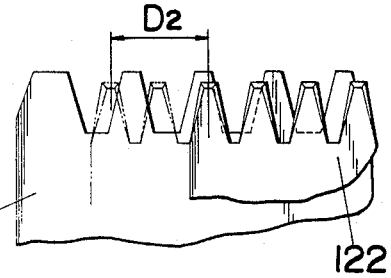
Figure 23A:
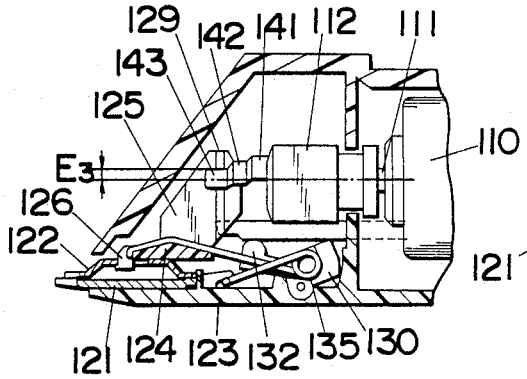
Figure 23B:
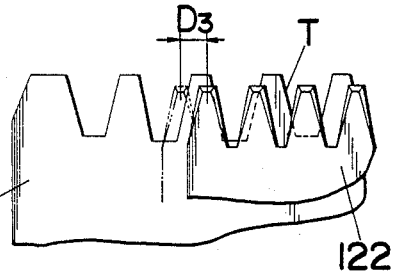

Operation of the hair clipper will be explained with reference to FIGS. 21 to 23. As shown in the figures, each of the stationary blade 121 and the movable blade 122 have a row of teeth of equal depth spaced evenly along the forward edge but with a differing pitch form each other. The movable blade 122 is caused to reciprocate while being fixed in the direction perpendicular to the reciprocation, as opposed to the previously described first embodiment. When the carrier plate 124 is kept in the rearwardmost position of FIG. 21A, the rib 129 of carrier plate 124 comes into engagement with the eccentric shaft 140 at the sections 141 of maximum eccentricity E1 to thereby reciprocate the movable blade 122 at a maximum amplitude D1 as indicated in FIG. 21B. This amplitude D1 allows each tooth of the movable blade 122 to be in shearing engagement with a maximum number of the teeth of the stationary blade 121, whereby providing a hair cutting mode in which all teeth of the stationary blade 121 and the movable blade 122 are most effectively utilized to give a maximum shearing capability for the hair cutting operation. When the actuator rod 107 is advanced to horizontally shift the carrier plate 124 into an intermediate position of FIG. 22A, the rib 129 comes into engagement with the eccentric shaft 140 at the section 142 of medium eccentricity E2 so as to reciprocate the movable blade 122 at a medium amplitude D2 as indicated in FIG. 22B. In this condition, each tooth of the movable blade 122 is cooperative with a limited number of the teeth of the stationary blade 122 appearing within the amplitude D2 for providing a hair trimming mode with reduced shearing capability as compared to the hair cutting mode. That is, more than one but less number of the teeth of the stationary blade 121 than in the hair cutting mode are cooperative with each tooth of the movable blade 122 to give a hair shearing performance of rather reduced capability effective for the hair trimming. When the actuator rod 107 is further advanced to shift the carrier plate 124 into its forwardmost position of FIG. 23A, the rib 129 comes into engagement with the eccentric shaft 140 at the section 143 of minimum eccentricity E3 so as to drive the movable blade 122 at a minimum amplitude D3 of reciprocation, as indicated in FIG. 23B. The minimum amplitude D3 is such that it permits the stationary blade 121 to be in hair shearing engagement with the movable blade 122 at only the particular ones (indicated by T in FIG. 23B) of the teeth of the stationary blade 121 occurring at an interval at least double the pitch between the adjacent teeth of the stationary blade 121, thereby providing a hair thinning performance. Such hair thinning action effected at the local teeth results from that the stationary and the movable blades 121 and 122 have the teeth of differing pitches.

What is claimed is:

1. A hair clipper comprising:

a stationary blade having a forward edge with a row of teeth extending therealong;

a movable blade having a forward edge with a row of teeth extending therealong;

drive means for causing reciprocating movement of said movable blade relative to the stationary blade in shearing engagement between the teeth of the blades;

mode selection means for selectively engaging the movable blade with the stationary blade in at least one of a hair cutting condition, a hair trimming condition, and a hair thinning condition, each of said conditions having an effective shearing zone of different shearing capability from each other, wherein said hair cutting condition providing a first effective shearing zone which is defined by substantially having the entire teeth of the stationary blade in hair shearing engagement with those of the movable blade, wherein said hair trimming condition providing a second effective shearing zone which is defined by having particular regions of the teeth of said stationary blade in hair shearing engagement with the corresponding teeth of said movable blade, and wherein said hair thinning condition providing a third effective shearing zone which is defined by having particular ones of the teeth of the stationary blade in hair shearing engagement with the corresponding teeth of said movable blade, wherein said drive means is for further varying the rate of reciprocation of said movable blade in response to said made selection means which engages said movable blade with said stationary blade between the hair cutting and hair trimming conditions.

2. A hair clipper as set forth in claim 1, wherein said mode selection means comprises a handle for effecting the relative shifting movement of the movable blade to the stationary blade in a direction of varying the distance between the forward edges of said movable and stationary blades, said stationary blade being formed in its forward edge with the row of teeth composed of first teeth of small depth and second teeth of larger depth, said first teeth being divided into several groups which are alternated by said second teeth;

said mode selection means causing the said movable blade to relatively shift selectively into said hair cutting condition in which substantially the entire depth of each of the first teeth and the corresponding depth of the second teeth of the stationary blade are in hair shearing engagement with those of the movable blade, whereby defining said first effective shearing zone, into said hair trimming condition in which only the bottom portions of each of the first and second teeth of the stationary blade are in hair shearing engagement with those of the said movable blade, whereby defining said second effective shearing zone, and into said hair thinning condition in which only the bottom portion of each of the second teeth of the stationary blade is in hair shearing engagement with those of the movable blade, whereby defining said third effective shearing zone.

3. A hair clipper as set forth in claim 1, wherein said mode selection means comprises a handle operatively connected to said movable blade for shifting the movable blade in a direction of varying the distance between the forward edges of said movable and stationary blades, said stationary blade being formed in its forward edge with the row of teeth composed of first teeth of small depth and second teeth of larger depth, said first teeth being divided into several groups which are alternated by said second teeth;

said mode selection means causing said movable blade to shift selectively into said hair cutting condition in which substantially the entire depth of each of the first teeth and the corresponding depth of the second teeth of the stationary blade are in hair shearing engagement with those of the movable blade, whereby defining said first effective shearing zone, into said hair trimming condition in which only the bottom portions of each of the first and second teeth of the stationary blade are in hair shearing engagement with those of the said movable blade, whereby defining said second effective shearing zone, and into said hair thinning condition in which only the bottom portion of each of the second teeth of the stationary blade is in hair shearing engagement with those of the movable blade, whereby defining said third effective shearing zone.

4. A hair clipper as set forth in claim 3, wherein the forward edge of the movable blade is displaced rearwardly from that of the stationary blade by a distance of 1.5 mm when the movable blade is shifted into the hair trimming condition.

5. A hair clipper as set forth in claim 1, wherein said mode selection means comprises a comb member formed in its forward edge with a limited number of comb teeth arranged in parallel relation with the rows of teeth of said stationary blade and spaced to each other at an interval at least double that of the teeth of the stationary blade, said comb member being shiftable in a direction perpendicular to the forward edges thereof in relation to said stationary blade, said comb member being arranged to be shifted selectively into the hair cutting condition in which the comb member is retracted rearwardly of the teeth of the stationary blade to expose all of the teeth, whereby defining said first effective shearing zone, into the hair trimming condition in which the forward edge of the comb member extends over the bottom portions of the teeth of said stationary blade to render those portions inoperative while leaving exposed the top portions of the teeth and the entire depth of the particular teeth in registration with the comb teeth for limited shearing operation by those exposed teeth, whereby defining said second effective shearing zone, and into the hair thinning condition in which the comb member extends over the entire depth of the teeth of the stationary blade so as to expose only the particular teeth associated with the comb teeth for a further limited shearing operation while rendering the remaining teeth inoperative, whereby defining said third effective shearing zone.

6. A hair clipper as set forth in claim 1, wherein said mode selection means comprises control means for varying the amplitude of reciprocation of the movable blade selectively between a first, a second, and a third modes of different amplitudes respectively determining said hair cutting, trimming, and thinning conditions;

said first mode providing a maximum amplitude of reciprocation which permits each tooth of the movable blade to be in shearing engagement with a maximum number of the teeth of the stationary blade, whereby defining therebetween said first effective shearing zone in which the entire teeth of the movable and stationary blades are most effectively utilized to provide a maximum shearing capability;

said second mode providing a medium amplitude of reciprocation which permits each tooth of the movable blade to be in shearing engagement with a less number of the teeth of the stationary blade than in the first mode, whereby defining said second effective shearing zone effecting a reduced hair shearing capability; and said third mode providing a minimum amplitude of reciprocation which permits only a selected number of the teeth of the stationary blade to be in shearing engagement with the corresponding teeth of the movable blade while rendering the remaining teeth of the stationary blade to be out of shearing engagement therewith, whereby defining said third effective shearing zone in which the hair sharing is effected only at particular teeth of the stationary blade.

7. A hair clipper as set forth in claim 6, wherein said drive means comprises an electric motor with an output shaft of which rotational movement is translated into the reciprocating movement of the movable blade; and said control means comprises a stepped eccentric shaft connected at its one end to said motor output shaft in an eccentric relation thereto, said eccentric shaft being formed with a first, a second, and a third stepped sections each extending in parallel relation with different eccentricity from an axis of the motor output shaft, each of the sections being selectively engageable with a portion of said movable blade so as to reciprocate it upon the rotation of the eccentric shaft; said eccentricity decreasing in a step-wise manner from the first section, second section, and to the third section such that these sections define respectively said first, second, and third modes of reciprocation when engaged with the movable blade.

8. A hair clipper as set forth in claim 5, wherein said drive means is associated with means for varying the rate of reciprocation of the movable blade.

9. A hair clipper, comprising:

a stationary blade having a forward edge with a row of teeth extending therealong;

a movable blade having a forward edge with a row of teeth extending therealong;

drive means for causing reciprocating movement of said movable blade relative to the stationary blade in shearing engagement between the teeth of the blades;

mode selection means for selectively engaging the movable blade with the stationary blade in at least one of a hair cutting condition, a hair trimming condition, and a hair thinning condition, each of said conditions having an effective shearing zone of different shearing capability from each other, wherein said hair cutting condition providing a first effective shearing zone which is defined by substantially having the entire teeth of the stationary blade in hair shearing engagement with those of the movable blade, wherein said hair trimming condition providing a second effective shearing zone which is defined by having particular regions of the teeth of said stationary blade in hair shearing engagement with the corresponding teeth of said movable blade, and wherein said hair thinning condition providing a third effective shearing zone which is defined by having particular ones of the teeth of the stationary blade in hair shearing engagement with the corresponding teeth of said movable blade, wherein said drive means is for further varying the rate of reciprocation of said movable blade in response to said mode selection means engaging said movable blade with said stationary blade between the hair cutting and hair trimming conditions, wherein said mode selection means comprises a handle for effecting the relative shifting movement of the movable blade to the stationary blade in a direction of varying the distance between the forward edges of said movable and stationary blades, said stationary blade being formed in its forward edge with the row of teeth composed of first teeth of small depth and second teeth of larger depth, said first teeth being divided into several groups which are alternated by said second teeth, wherein said mode selection means causing the said movable blade to relatively shift selectively into said hair cutting condition in which substantially the entire depth of each of the first teeth and the corresponding depth of the second teeth of the stationary blade are in hair shearing engagement with those of movable blade so as to define said first effective shearing zone, into said hair trimming condition in which only the bottom portions of each of the first and second teeth of the stationary blade are in hair shearing engagement with those of the said movable blade so as to define said second effective shearing zone, and into said hair thinning condition in which only the bottom portion of each of the second teeth of the stationary blade is in hair shearing engagement with those of the movable blade, whereby defining said third effective shearing zone, and wherein said drive means is for further varying the rate of reciprocation of the movable blade in response to said mode selection means engaging said movable blade with said stationary blade between the hair cutting and hair trimming conditions.

10. A hair clipper as set forth in claim 9, wherein said movable blade is reciprocated at a slower rate in the hair trimming condition than in the hair cutting condition.

11. A hair clipper as set forth in claim 9, wherein said drive means is for further automatically varying the rate of reciprocation of the movable blade in response to said mode selection means which engages said movable blade with said stationary blade between the hair cutting and the hair trimming conditions.

* * * * *